US005794309A

United States Patent [19]

Lotz

[11] Patent Number: 5,794,309

[45] **Date of Patent: *Aug. 18, 1998**

[54] HINGE AND LOCK ASSEMBLY FOR A MOTOR VEHICLE DOOR

[75] Inventor: Norbert Lotz, Leichlingen, Germany

[73] Assignee: ED. Scharwächter GmbH & Co. KG, Remscheid, Germany

[ * ] Notice: The term of this patent shall not extend beyond the expiration date of Pat. No. 5,575,037.

[21] Appl. No.: 796,643

[22] Filed: Feb. 7, 1997

[30] Foreign Application Priority Data

Feb. 20, 1996 [DE] Germany ..... 196 06 186.5

[51] Int. Cl.[6] ..... E05D 11/10

[52] U.S. Cl. ..... 16/334; 16/308; 16/297; 16/261; 16/270

[58] Field of Search ..... 16/334, 333, 332, 16/308, 296, 297, 335, 261, 262, 263, 270

[56] References Cited

U.S. PATENT DOCUMENTS

| | | | |
|---|---|---|---|
| 3,550,185 | 12/1970 | Marchione | 16/297 |
| 4,536,918 | 8/1985 | Brockhaus | 16/308 |
| 4,765,025 | 8/1988 | Salazar | 16/261 |
| 4,807,331 | 2/1989 | Calucci | 16/262 |
| 5,570,498 | 11/1996 | Hipkiss et al. | 16/261 |
| 5,575,037 | 11/1996 | Tolle et al. | 16/334 |
| 5,590,441 | 1/1997 | Spencer | 16/261 |

*Primary Examiner*—Chuck Mah
*Attorney, Agent, or Firm*—Anderson Kill & Olick, P.C.

[57] ABSTRACT

A hinge and lock assembly for releasably mounting a vehicle door on a door pillar of a vehicle including two hinge flaps attachable to the door and the door pillar, respectively, a hinge pin for pivotally connecting the two flaps with each other, a support releasably attachable to the door pillar for attaching the hinge to the door pillar an indexing arrangement formed on the hinge flap attachable to the door pillar and including alternating, following each other projections and indentations which cooperate with the torsion bar of the door lock for locking the door in a predetermined position, and a plurality of holding members pivotally supported on one leg of the door pillar hinge flap and cooperating with respective indentations of the indexing arrangement for holding a weighting arm of the torsion bar.

12 Claims, 2 Drawing Sheets

HINGE AND LOCK ASSEMBLY FOR A MOTOR VEHICLE DOOR

BACKGROUND OF THE INVENTION

The present invention relates to a hinge and lock assembly for releasably mounting a vehicle door on a door pillar of a vehicle and including two hinge flaps attachable to the door and the door pillar, respectively, a hinge pin for pivotally connecting the two flaps with each other and having an extension projecting beyond a height of the assembly, a support releasably attachable to the door pillar for attaching the hinge to the door pillar, with the support having a base for supporting the hinge flap attachable to the door pillar and an opening provided in the base for receiving the hinge pin extension, a torsional door lock having a torsion bar fixedly supported on the hinge flap attachable to the vehicle door pillar, and an indexing arrangement formed on the hinge flap attachable to the door pillar and including alternating, following each other projections and indentations which cooperate with the torsion bar of the door lock for locking the door in a predetermined position.

Vehicle doors attachable to the vehicle body need all be provided with a door lock in order, on one hand, to prevent detachment of the door during its opening, especially when a restricted space is available for opening of the door or when the vehicle is located underground, and on the other hand, to prevent an undesirable flapping of the door when a vehicle stands on an inclined surface.

To this end, the vehicle door lock should insure a precise locking of the door in a predetermined indexing position with an adequate holding force and as quietly as possible. To achieve this, preferably, torsional door locks are used because they require little space for their mounting. The conventional torsional door locks include a torsional spring the weighting arm of which is associated with two abutment rollers having a toothed circumference which serve as an indexing device. The abutment rollers are spaced from each other at a more or less considerable distance which, in any case, exceed their diameter. Upon opening of the door, the weighting arm engages the first of the two abutment rollers in the vicinity of the first indexable door opening position and, in this position, extends away from the first abutment roller a certain amount. The engagement of the weighting arm with the first abutment rollers causes braking of the opening movement of the door until the weighting arm, upon further opening of the door finally, after partial further rotation of the first abutment roller, becomes engaged with the second abutment roller and is retained between the two abutment rollers.

The drawbacks of the door lock with two abutment rollers, which are provided with a toothed circumference, consist in that the indexing device allows only for two indexing position, and in that the weighting arm, upon its engagement with the second abutment roller, occasionally strikes a tooth of the second abutment roller and, therefore, is not exactly locked. As a result, the vehicle door deviates, within a certain angle, from the predetermined indexing position during both opening and closing of the door. However, the main drawback of the conventional door locks consists in that it allows maximum for two indexing positions.

Further, conventionally, the door lock is separated from the door hinge. The use of a combined hinge and lock assembly for a vehicle door is accompanied, in most cases, with a significant reduction in expenses associated with manufacturing and mounting of the door attachment elements.

At present, during assembly of a vehicle, doors, at least temporarily, are secured on a vehicle body with a predetermined orientation and are then varnished, together with the body.

After the varnishing, the doors should be taken off the body in order to equip the body with its interior fittings, e.g., seats, roof, dashboard, pedals, and the like, and in order to outfit the doors themselves, e.g., with window regulators, locks, internal lining, etc. Thereafter, the doors are again mounted on the body.

There exist numerous types of hinge and door lock assemblies including a hinge half or flap, which is releasably mounted on a door pillar with an aid of a support, which is releasably attached to the door pillar, extends transverse to the hinge axis, and has an opening for receiving an extension of a hinge pin, which connects the two flaps of the hinge. The support is attachable to the body by a connection element which is fixedly connected with the body.

However, the conventional connection elements are characterized by an increased weight and their mounting on door pillars is accompanied by increased costs.

Accordingly, an object of the invention is a hinge and door assembly for a demountable vehicle door which would have a reduced weight and which would occupy less mounting space.

Another object of the invention is a hinge and lock assembly for a demountable vehicle door which would reliably retain the vehicle door in a predetermined indexing position, without any oscillating movement, and would insure absorption of high holding forces of the door lock, which are necessary to prevent the oscillating movement of the door, by the hinge and the connection members which provide for the attachment of the hinge to the door pillar.

A still further object of the invention is a hinge and lock assembly for a vehicle door which would be characterized by reduced manufacturing and mounting costs, while providing for error-free mounting of the door lock and, in particular, of the lock holding member.

SUMMARY OF THE INVENTION

These and other objects of the invention, which will become apparent hereinafter, are achieved by providing a hinge and lock assembly of the above-described type in which the hinge flap, which is attached to the door pillar, is formed of a folded sheet material section and has a substantially U-shape, which assembly further comprises a plurality of holding members pivotally supported on one leg of the U-shaped hinge flap and cooperating with respective indentations of the indexing arrangement for holding a weighting arm of the torsion bar, with another opposite leg of the U-shaped hinge flap being provided with a projection form-lockingly engageable in another opening provided in the support base.

The hinge and lock assembly according to the present invention is characterized in that it insures retaining of the vehicle door in at least three indexing positions, without any oscillating movement of the door in any of the indexing positions. Further, the hinge and lock assembly according to the present invention insures absorption by the door pillar or by the support attachable to the door pillar of impact forces caused by the door movement which prevents the hinge flap, attachable to the door pillar, and the connection elements, used for attaching this hinge flap to the door pillar, from being subjected to high sign-variable impact forces generated by the movement of the vehicle door in opposite directions. Furthermore, the hinge and lock assembly according to the present invention permits to provide a lighter hinge half, which carries the indexing device, and insures a reliable attachment of the door pillar hinge half or flap to the door pillar with a single bolt.

According to a preferred embodiment of the hinge and door assembly according to the present invention, the plurality of holding members comprises three identical holding members having, at least over a portion of a height thereof, a substantially heart-shaped cross-section, and bearing axles of the holding members are arranged on the door hinge flap and are spaced from each other a distance slightly smaller than a largest diameter of the cross-section of the holding members.

In comparison with the used, up to the present, conventional holding members formed as abutment rollers with a toothed circumference, the holding members according to the present invention permit to substantially simplify the manufacturing of the hinge and lock assembly by manufacturing the holding members from a suitable profiled material. The holding members according to the present invention not only insure obtaining of a plurality of indexing positions but also the reliability of indexing of the door in a required position. Furthermore, the holding members according to the present invention insure their error-free mounting as well as a required orientation.

In an especially preferred embodiment of the hinge and lock assembly of the present invention, the holding members have, in their respective central regions, a circular cross-section, and two overhangs are provided, respectively, on opposite sides of the circular cross-section, with one of the overhangs having a recess and another of the overhangs having a wedge shape.

Further, the two overhangs are symmetrical with respect to each other, and the recess in the one of the overhangs has a profile corresponding to a cross-section of the weighting arm. Generally, the weighting arm of the torsional spring has a circular cross-section. However, it can have another cross-section, e.g., a weighting arm having a square cross-section can also be used.

When the weighting arm has a circular cross-section, the recesses of the adjacent, pivotal relative to each other, holding members form together a semi-circle. This advantageously insures a smooth, backlash-free and jolt-free movement of the weighting arm form one abutment roller to the following abutment roller, so that the weighting arm moves, during the door movement, smoothly from the indexing recess of one abutment roller into the indexing recess of another abutment roller, which insures its interrupted movement and, thereby a noiseless operation of the door lock.

Advantageously, lateral surfaces of the wedge-shaped overhang form an angle of 97°, with the wedge-shaped overhang forming a stop for an abutment roller, and with the holding member having a pivotal region of between 90° and 100°, preferably 97°.

In a most preferred embodiment of a hinge and lock assembly according to the present invention, the holding members have a uniform cross-section over their entire height and are supported on bearing axles which are provided with a circumferential fluting which secure the axles against rotation in respective openings provided in the indexing arrangement. At that, the holding members are pivotally supported on the respective bearing axles against a biasing force of respective spring washers, which perform a braking function to prevent an automatic pivotal movement of the holding members. This further provides for a noiseless operation of the door lock.

Advantageously, the bearing axles of the holding members are arranged along an arcuate surface concentric with respect to the hinge axis.

The indexing arrangement is further provided with a nose which forms a stop for limiting an opening angle of the door.

To reduce the weight of the hinge and lock assembly according to the present invention and to reduce the mounting space therefor, without adversely affecting the stability of the assembly, the support of the door pillar hinge flap is formed as a right angle flat material section, a downward directed leg of which defines a connection leg attachable to the door pillar and another leg of which forms the base.

According to the invention, in order to eliminate the formation of a varnish deposit on the edges, which may be formed when the door is taken off the vehicle body after varnishing, the support is provided with a thin shim which extends along the entire height of the connection leg and of the bearing surface of the door pillar hinge flap. The shim can be attached to the connection leg, e.g., by welding.

The connection leg can be secured to the door pillar by a welded projection formed on the door pillar and extending through the shim.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 2:
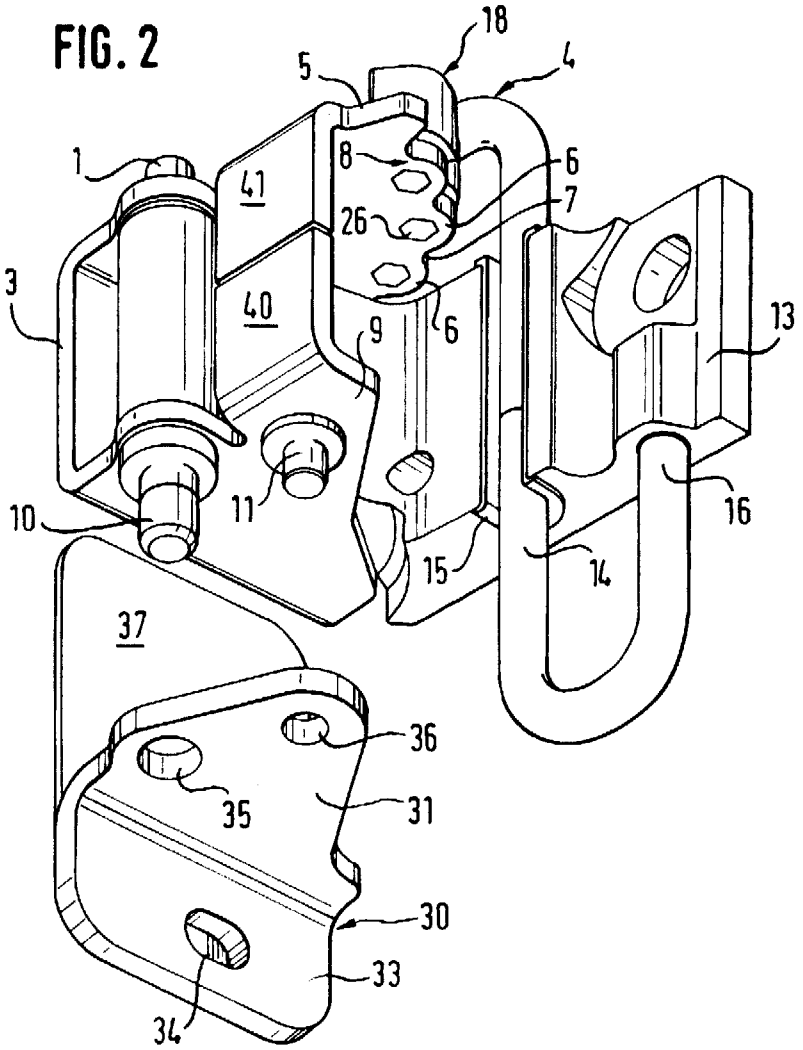
FIG. 2 is a perspective view of the hinge and lock assembly shown in FIG. 1 in pre-assembled condition.
Figure 1:
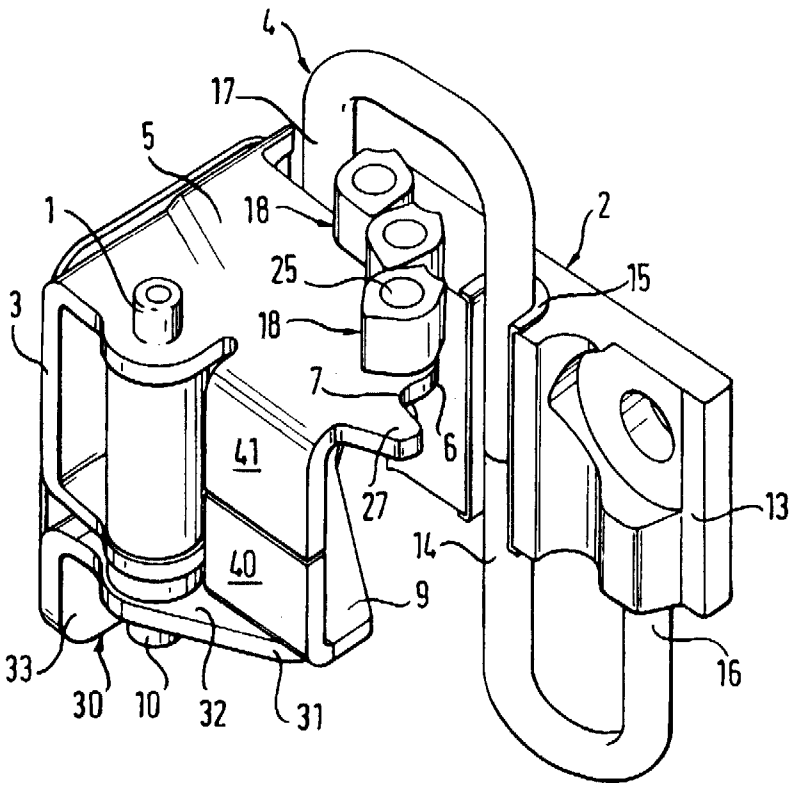
FIG. 1 is a perspective view of a hinge and lock assembly according to the present invention.
Figure 5:
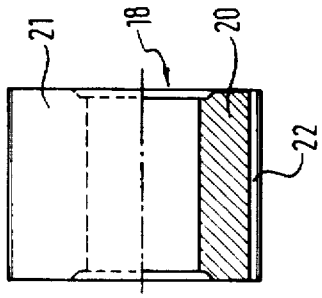
FIG. 5 a cross-sectional view of the holding member shown in FIG. 4 along line 5—5)
Figure 4:
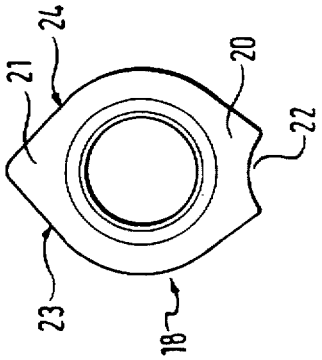
FIG. 4 is a top view of the holding member (at an enlarged scale) of the assembly shown in FIG. 1.
Figure 6:
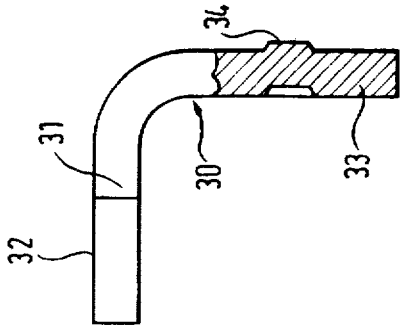
FIG. 6 is a side view of a support used in the assembly of FIG. 1.
Figure 7:
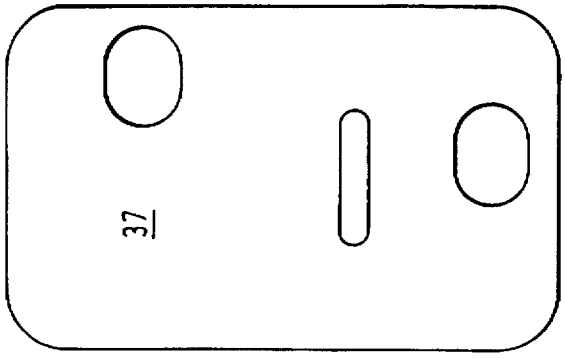
FIG. 7 is a top view of a shim used in the assembly of FIG. 1.
Figure 3:
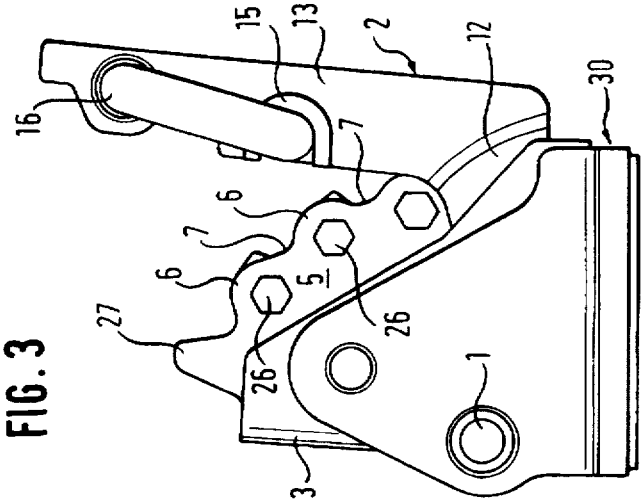
FIG. 3 is a top view of the assembly shown in FIG. 1.

A hinge and lock assembly according to the present invention for demountable vehicle doors, which is shown in the drawings, includes a hinge formed of two hinge flaps 2 and 3 pivotally connected by a hinge pin 1, with the one flap, flap 2, being attachable to a door (not shown in the drawings) and another flap, flap 3, being releasably attachable to a door pillar (likewise not shown in the drawings). The hinge and lock assembly according to the present invention further includes a torsional door lock 4. The flap 3, which is attachable to the door pillar, is formed of a folded sheet material section and has essentially a U-shape with two legs 5 and 9 extending transversely to the hinge axis. An indexing arrangement 8, which includes alternating projections 6 and indentations 7, is provided on the upper leg 5, and peg-shaped projection 11, which extend parallel to an extension 10 of the hinge pin 1, is provided on the lower leg 9. The peg-shaped projection 11 is provided adjacent to bent-off base portions 40 and 41 of the legs 5 and 9. Inside the hinge, the hinge flap 3 encompasses the hinge flap 2 connectable to the door. The hinge flap 2 is formed by a section of a hinge profile material and has an approximately L-shape. The hinge flap 2 has a shaped leg 12, with which the hinge flap 2 is pivotally attached to the hinge flap 3, by the hinge pin 1, and a shaped leg 13 attachable to the door. The torsional door lock 4, which is structurally connected with the hinge, includes a S-shaped member formed of a stem 14 retained in a support shell 15 provided in the hinge flap 2, a support arm 16 supported against the hinge flap, and a torsion bar the weighting arm 17 of which projects above flaps 2 and 3. The weighting arm 17 cooperates with the indexing arrangement 8 of the door lock 4 and defines three indexing positions of the door. The indexing arrangement 8 also includes three holding members 18, which are arranged adjacent to each other, rotate about respective vertical axes, and are supported on respective projections 6. The holding members 8 cooperate, in their respective indexing positions, with the weighting arm 17 of the torsion bar.

In the embodiment shown in the drawings, the holding members are of the same height and have essentially a heart-shaped cross-section. The holding member 18 has, in its central region 19, a circular cross-section. On opposite sides of the central region 19, there are provided symmetrically arranged radial overhangs 20 and 21, with one of the overhangs, overhangs 20, having an indexing recess 22 and with the other overhang 21 having a wedge-like shape. The recess 22 has a circular cross-section corresponding to the cross-section of the weighting arm 17. The recess 22 has a profile corresponding to a quarter of a circle, so that two recesses of the adjacent overhangs 20 of two holding members 18 form a semicircle. Two opposite lateral surfaces 23 and 24 of the wedge-shaped overhang 21 form a stop for an adjacent holding member 18. The maximum possible pivotal region of the adjacent holding member 18 is limited to 97°. The holding member 18 has, over its entire height, a uniform cross-sectional shape and is supported on a bearing axle 25, which is held by circumferential fluting against rotation in the bore of the corresponding projection 6 of the indexing arrangement 8 and which forms a peg 26. The bearing axles of the holding members 18 are arranged, on the hinge flap 3, along an arc lying concentrically with respect to the hinge axis. Finally, the indexing arrangement 8 has, in its end region, a nose 27 which forms a stationary stop limiting the opening movement of the vehicle door.

The hinge and lock assembly, which is secured to the door pillar by its flap 3, cooperates with a support 30, which is fixedly secured to the door pillar and projects forward therefrom. The support 30 is formed by a section of a flat material bent to form a right angle, the leg 31 of which forms a base 32, which extends transverse to the hinge axis, for the hinge flap 3. The other leg 33 of the support 30 serves as a connection leg and is fixedly secured to the door pillar, e.g., by a welded boss 34. The connection leg 33 of the support 30 extends downward and, therefore, extends away from the bearing surface of the flap 3. The leg 31 of the support 30, which forms the base 32 for the flap 3, has two openings 35 and 36. The opening 35 receives the extension 10 of the hinge pin 1, and the opening 36 receives the peg-shaped projection 11 provided on the flap 3. The two openings 35 and 36 provide for reliable mounting of the hinge on the support 30.

A thin shim 37 is associated with the connection leg 33. The shim 37 extends along the entire height of the connection leg 33 and the entire height of the bearing surface of the flap 3 which abuts the door pillar. The shim 37 can be attached to the support 30, e.g., by welding. The connection leg 33 can be secured to the door pillar by a welded projection extending through the shim 37.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A hinge and lock assembly for releasably mounting a vehicle door on a door pillar of a vehicle, the assembly comprising:

two hinge flaps attachable to the door and the door pillar, respectively;

a hinge pin for pivotally connecting the two flaps with each other, the hinge pin having an extension projecting beyond height of the assembly;

a support releasably attachable to the door pillar for attaching the hinge to the door pillar, the support having a base for supporting the hinge flap attachable to the door pillar and an opening provided in the base for receiving the hinge pin extension;

a torsional door lock having a S-shaped torsion bar fixedly supported on the hinge flap attachable to the vehicle door; and an indexing arrangement formed on the hinge flap attachable to the door pillar and including alternating, following each other projections and indentations which cooperate with the torsion bar of the door lock for locking the door in a predetermined position, wherein the hinge flap attachable to the door pillar is formed of a folded sheet material section and has a substantially U-shape, wherein the assembly further comprises a plurality of holding members pivotally supported on one leg of the U-shaped hinge flap and cooperating with respective indentations of the indexing arrangement for holding a weighting arm of the torsion bar, and wherein another opposite leg of the U-shaped hinge flap is provided with a projection form-lockingly engageable in another opening provided in the support base.

2. A hinge and lock assembly as set forth in claim 1, wherein the plurality of holding members comprises three identical holding members having at least over a portion of a height thereof a substantially heart-shaped cross-section, and wherein bearing axles of the holding members are arranged on the hinge flap attachable to the door and are spaced from each other a distance slightly smaller than a largest diameter of the cross-section of the holding members.

3. A hinge and lock assembly as set forth in claim 2, wherein the bearing axles of the holding members are arranged along an arcuate surface provided on the door-attachable hinge flap concentric with respect to a hinge axis.

4. A hinge and lock assembly as set forth in claim 1, wherein the holding members have, in their respective central regions, a circular cross-section, and two overhangs provided, respectively, on opposite sides of the circular cross-section, with one of the overhangs having a recess and another of the overhangs having a wedge shape.

5. A hinge and lock assembly as set forth in claim 3, wherein lateral surfaces of the wedge-shaped overhang form an angle of 97°, and wherein the holding member has a pivotal region of between 90° and 100°.

6. A hinge and lock assembly as set forth in claim 5, wherein the pivotal region of the holding member is 97°.

7. A hinge and lock assembly as set forth in claim 4, wherein the two overhangs are symmetrical with respect to each other, and wherein the recess in the one of the overhangs has a profile corresponding to a cross-section of the weighting arm.

8. A hinge and lock assembly as set forth in claim 7, wherein the weighting arm of the torsion bar has a circular cross-section, and wherein the two recesses of the adjacent holding members form together a semicircle.

9. A door and lock assembly as set forth in claim 1, wherein the indexing arrangement has a nose which forms a stop limiting an opening angle of the door.

10. A door and hinge assemble as set forth in claim 1, wherein the support has a connection member, at which the support is attached to the door pillar, the connection member extending at an angle to the base.

11. A door and hinge assembly as set forth in claim 1, wherein the support is formed as a right angle flat material section, a downward directed leg of which defines a connection member attachable to the door pillar and another leg of which forms the base.

12. A door and lock assembly as set forth in claim 11, wherein the support has a thin shim along an entire height of the connection leg and of a bearing surface of the U-shaped flap adjoining the door pillar.

* * * * *